US006425563B1

(12) United States Patent
Mihailoff

(10) Patent No.: US 6,425,563 B1
(45) Date of Patent: Jul. 30, 2002

(54) CLAMP FOR A RETAIL DISPLAY APPARATUS

(75) Inventor: Jerrold Mihailoff, Toronto (CA)

(73) Assignee: Wm. Prager Limited, Toronto (CA)

( * ) Notice: Subject to any disclaimer, the term of this patent is extended or adjusted under 35 U.S.C. 154(b) by 0 days.

(21) Appl. No.: 09/815,279

(22) Filed: Mar. 23, 2001

(51) Int. Cl.[7] ..... A47B 57/26
(52) U.S. Cl. ..... 248/245; 211/192; 248/297.21
(58) Field of Search ..... 211/94.01, 103, 211/162, 187, 190, 191, 192; 248/244, 245, 221.11, 222.14, 222.52, 225.11, 225.21, 295.11, 297.21, 243, 223.41; 108/110, 108, 106

(56) References Cited

U.S. PATENT DOCUMENTS 844,367 A * 2/1907 Knape ..... 248/245
982,279 A * 1/1911 Knape ..... 248/245
1,974,050 A * 9/1934 Keil ..... 248/243
4,895,331 A * 1/1990 Nehls ..... 108/108
5,154,385 A * 10/1992 Lindberg et al. ..... 248/225.11

FOREIGN PATENT DOCUMENTS

GB 2181037 A * 4/1987

* cited by examiner

*Primary Examiner*—Leslie A. Braun
*Assistant Examiner*—Jon Szumny
(74) *Attorney, Agent, or Firm*—Bereskin & Parr

(57) ABSTRACT

A clamp for use on a retail or commercial display device wherein a rod is slidingly received in a channel and selectively positionable therein by an position locking member. A hook plate attached to a display element, such as shelving, hanger rods, etc. has hooks for engaging a bolt mounted to the rod. A knob on the bolt is tightened to clamp the hook plate between the rod, or the post, and the inner face of the knob. The clamp may be locked in position while the hook plate is released or attached. Similarly, the hook plate may stay clamped to the display while the position lock is released, thereby permitting the clamp to be moved along the channel while the hook plate is still clamped thereto.

23 Claims, 8 Drawing Sheets

CLAMP FOR A RETAIL DISPLAY APPARATUS

FIELD OF THE INVENTION

The present invention relates to commercial and retail display equipment and, more particularly, to an improved clamping system for use with such displays.

BACKGROUND OF THE INVENTION

Commercial and retail display racks and fixtures come in many shapes, sizes and configurations. While it is trite to say that commercial and retail display fixtures must be attractive and functional, increasingly there is a need for versatility to permit a vendor to display a variety of wares and-to redesign the display with minimal effort and expense.

One popular mode of retail and commercial display utilizes a pair or more fixed posts typically running from the floor to the ceiling. A plurality of holes or protruding pegs provided vertically along the posts permits shelves, bars, hanger racks or other display equipment to be selectively attached at the appropriate height levels. While versatile, this arrangement presents a problem in that a loaded rack or shelf is difficult to reposition since it must be removed entirely from the hole or peg and advanced to the next discreet hole or peg position. This requires not only strength but a fair amount of dexterity. Alternately, the display equipment must be unloaded of merchandise, repositioned and then reloaded.

A further solution proposed has been to provide a channel running vertically along the length of the support post to permit a sliding fastening system to be provided for the display equipment. These sliding fastening systems provide versatility over the discreet hole/peg systems in that an infinite number of display positions are available along the length of the channel. However, repositioning or changing the display equipment in either a loaded or unloaded condition, can still be a problem. Present clamping systems of this type, when unlocked to be repositioned or to change the display equipment, must be held in place manually in order to permit the clamp and/or the display equipment from dropping to the floor. Thus, two people are often required to do the job.

Accordingly, there is a need for an improved display clamping system, which is both versatile, interchangeable and easy to operate.

SUMMARY OF THE INVENTION

In a one aspect, the present invention provides an apparatus for displaying an article, the apparatus comprising a support having an elongate channel defined therein, the channel having an interior, a length and a mouth, the mouth adapted to provide exterior access to the channel interior substantially along the channel length, a display element for displaying an article, the display element having a plate portion, an elongate member adapted to be slidingly received and retained in the channel, the elongate member being shorter than the channel length, a position lock mounted on the elongate member and adapted to extend through the mouth of the channel when the elongate member is disposed in the channel, the position lock being operable to releasibly fix the elongate member in a selected position along the length of the channel; and, a clamp mounted on the elongate member and adapted to extend through the mouth of the channel when the elongate member is disposed in the channel, the clamp being operable to selectively releasibly secure the display element plate portion adjacent the support.

In a second aspect, the invention provides an adjustable display apparatus comprising, a display element for displaying at least one article, the display element having a plate portion, an elongate member adapted to be slidingly received and retained in a channel defined in a support, the channel being of the type having an interior and a mouth, the mouth adapted to provide exterior access to the channel interior substantially along the length of the channel, a position lock mounted on the elongate member and adapted to extend through the mouth of the channel when the elongate member is disposed in the channel, the position lock being operable to releasibly fix the elongate member in a selected position along the length of the channel and a clamp mounted on the elongate member and adapted to extend through the mouth of the channel when the elongate member is disposed in the channel, the clamp being operable to selectively releasibly secure the display element plate portion adjacent the support.

In a third aspect, the invention provides an adjustable display apparatus comprising a rod adapted to be slidingly received and retained in a channel defined in a support, the channel being of the kind having an interior and a mouth, the mouth adapted to provide exterior access to the channel interior substantially along the length of the channel, an clamp mounted on the rod, the clamp having a knob adapted to extend beyond the mouth of the channel when the rod is disposed in the channel, the knob of the clamp being operable to selectively releasibly secure the display element plate portion adjacent the support, a position lock mounted on the rod, the position lock having a bolt operable to selectively advance in the channel relative to the rod to releasibly fix the rod in a selected position along the length of the channel, and a display element for displaying at least one article, the display element having a plate portion, the plate portion having an hooked slot and a axial slot, the hooked slot adapted to engage the clamp, the axial slot adapted to engage the position lock.

BRIEF DESCRIPTION OF THE DRAWINGS

For a better understanding of the present invention and to show more clearly how it may be carried into effect, reference will now be made by way of example to the accompanying drawings, which show articles made according to a preferred embodiment of the present invention, in which.

DETAILED DESCRIPTION OF THE PREFERRED EMBODIMENT

Figure 1:
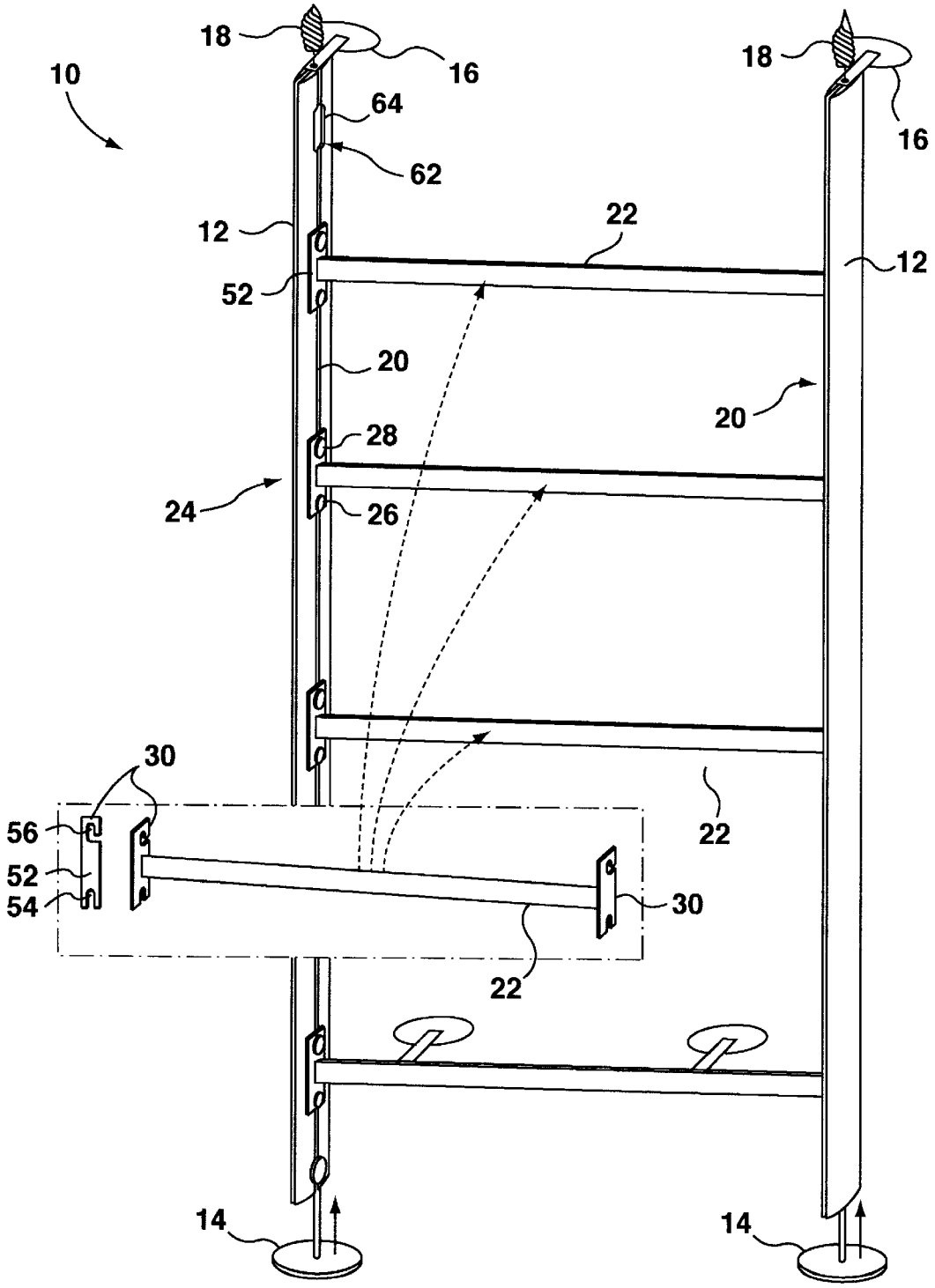
FIG. 1 is an isometric view of a retail display according to the present invention.

A retail display rack apparatus in accordance with the present invention is shown in the Figures generally at 10. Display rack 10 has a pair of supports or posts 12 which extend from a foot 14 to a wall-mount 16. A decorative ornament 18 may top posts 12. Posts 12 have a longitudinal channel 20 defined therein. Channel 20 may run the entire length of posts 12 or may only be provided only in a portion thereof, and may comprise the post or may be only a part of the post. Extending between posts 12 are a plurality of display elements 22 releasably fixed to posts 12 at each end by a display clamp assembly 24 according to the present invention. Each display clamp assembly 24 is provided with a position lock 26 and a clamp 28, as will be described in more detail below. Display element 22 has a hanger 30 disposed at each end thereof for engaging display clamp assembly 24, as will also be described in more detail below.

Figure 2:
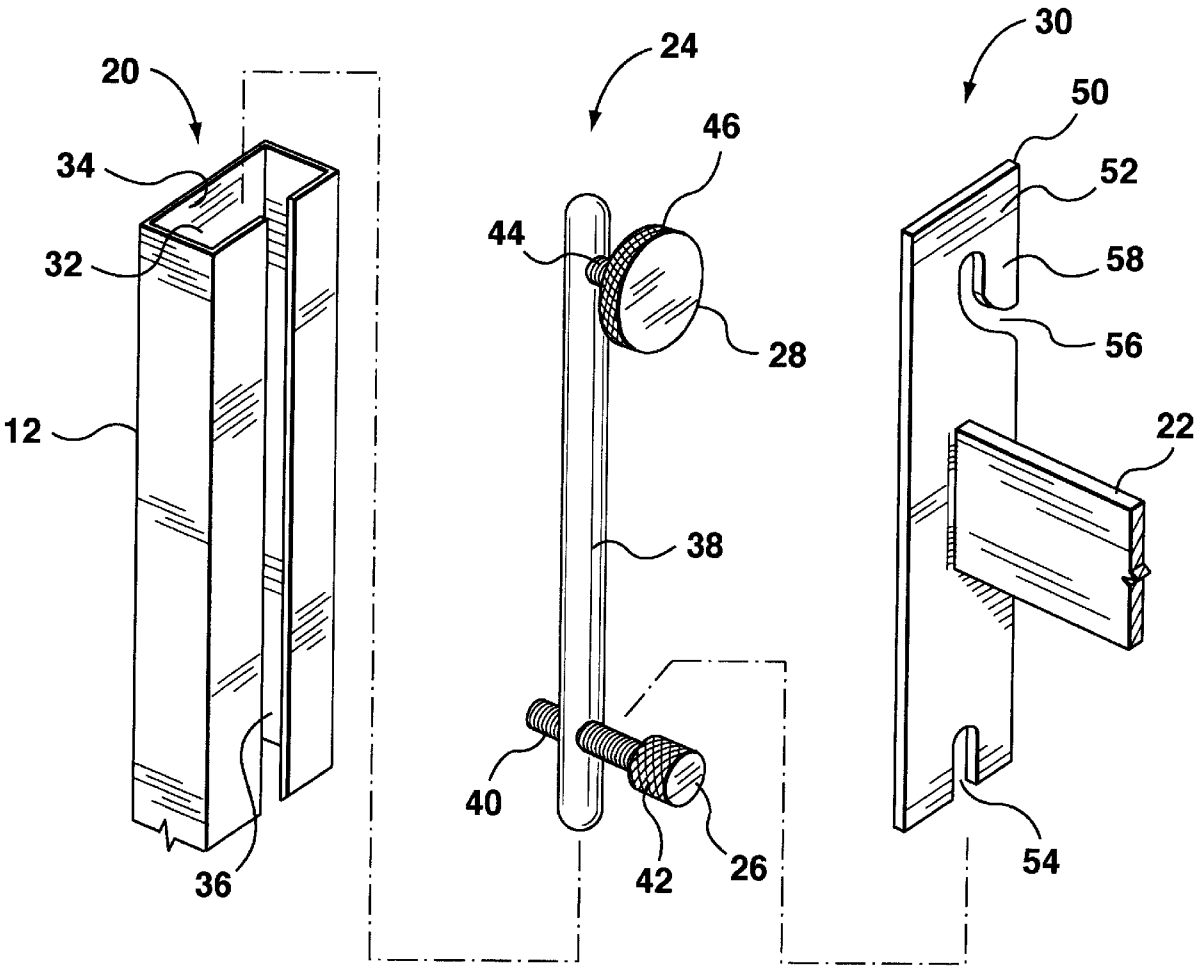
FIG. 2 is an exploded isometric view of the clamping system of FIG. 1.

Referring to FIG. 2, channel 20, display clamp assembly 24 and hanger 30 are shown. Channel 20 comprises an interior recess 32 in post 12 having an inner wall 34 and a mouth 36 which runs substantially along the length of channel 20. Display clamp assembly 24 comprises an elognate member or rod 38, which has position lock 26 and clamp 28 mounted thereon, and which is adapted to be slidingly received in recess 32. In this embodiment, position lock 26 is a bolt 40 threadingly received in rod 38 and having an exposed knurled head 42. Adjacent an opposite end of rod 38 is clamp 28, which in this embodiment comprises a bolt 44 threadingly received in rod 38 and having an exposed knurled head 46. For ease of identification, knurled heads 42 and 44 are preferably differently sized (or in some other manner different) so as to be immediately distinguishable from one another. For reasons which will become apparent below, bolt 40 is freely threadingly received in rod 38 so as to be capable of advancing at least partially through, or withdrawing at least partially from, rod 38 by turning knurled head 42. Bolt 44 is similarly configured.

Figure 4:
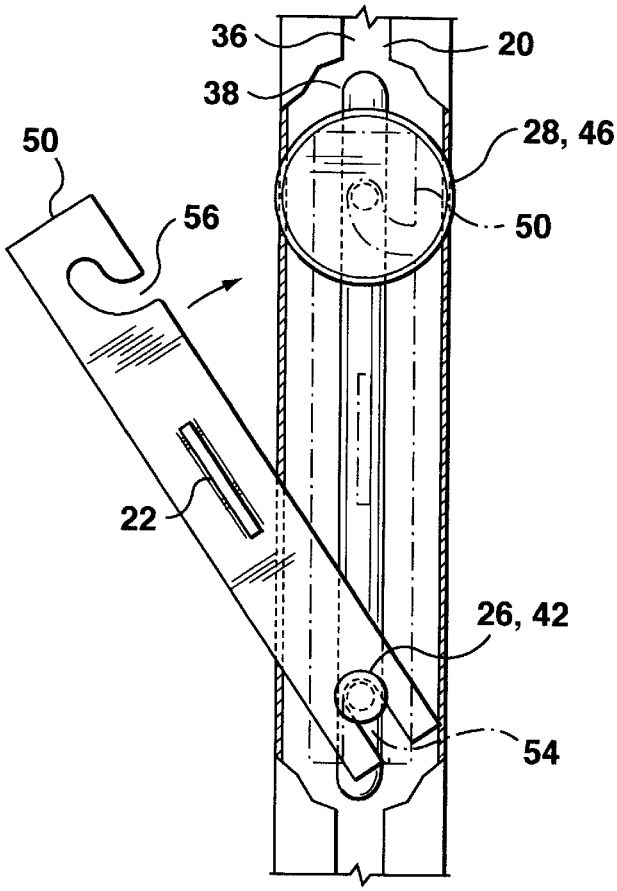
FIG. 4 is a plan view of the display clamp of FIG. 2, shown with a portion thereof removed for clarity.

In this embodiment, hanger 30 is a hook plate 50 comprising a plate 52 welded to each end of display element 22 and having a lower slot 54 and an upper slot 56. As will be described below, the inner ends of slots 54 and 56 are sized to approximately the same centre-to-centre distance of bolts 40 and 44 to permit hanger 30 to cooperate with display clamp assembly 24. Lower slot 54 is preferably sufficiently deep to permit it to continuously engage bolt 40 while upper slot 56 is slid over bolt 44, as shown in FIG. 4 and described in more detail below. Upper slot 56 defines a hook 58 in plate 52.

While the components described may be fabricated from almost any structural material, in the preferred embodiment post 12 is extruded aluminum and clamp assembly 24 and element 22 are made of steel.

Figure 3:
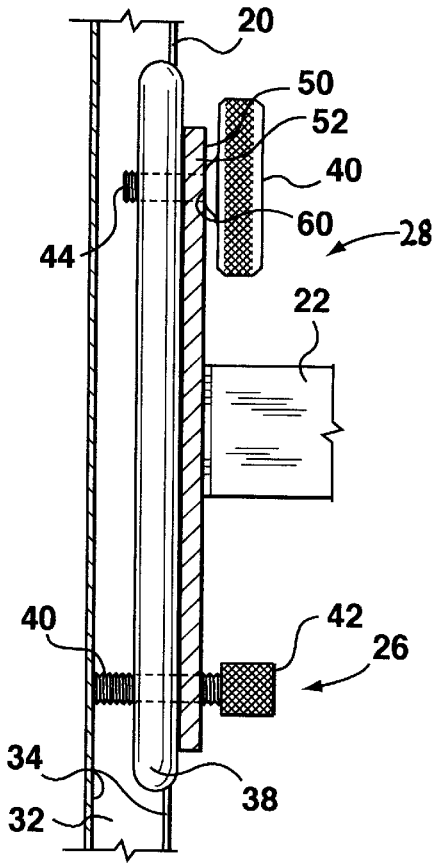
FIG. 3 is a sectional side view of the display clamp of FIG. 2, shown fully assembled.

Referring to FIG. 3, when display clamp assembly 24 is assembled, rod 38 is disposed inside recess 32 and bolt 40 of position lock 26 and bolt 44 of clamp 28 extend through mouth 36, so that knobs 42 and 46 are outside of channel 20. Bolts 40 and 44 are sized relative to mouth 36 so as to not hinder rod 38 from sliding in channel 20 (see FIGS. 6 and 8).

Referring to FIGS. 3 and 4, with rod 38 inside recess 32, hook plate 50 is installed thereon by sliding lower slot 54 onto bolt 40 and then upper slot 56 onto bolt 44. Hook plate 50 is then moved downwardly (as it is depicted in phantom lines in FIG. 4) to firmly seat bolts 40 and 44 at the bases of upper and lower slots 54 and 56 respectively. As shown in FIG. 3, when plate 52 is so positioned, it is disposed between rod 38 and knobs 42 and 46. Hook 58 is sufficiently strong to permit display element 22 to hang therefrom.

Figure 5:
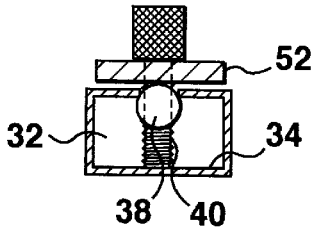
FIG. 5 is an end view along arrow 5 of the display clamp of FIG. 3 shown in a "locked" condition.

As stated above, bolt 40 of position lock 26 may be advanced into and withdrawn from rod 38. When fully advanced, bolt 40 of position lock 26 bears against inner wall 34 of recess 32, thereby forcing rod 38 in an opposite direction until it bears against inner wall 32 adjacent mouth 36, as shown in FIGS. 3 and 5. If bolt 40 is advanced sufficiently, the friction between bolt 40, rod 38 and inner wall 32 will prevent rod 38 from sliding in channel 20 relative to post 12. This condition is referred to herein as a "locked" condition. As shown in FIG. 5, knob 42 of position lock 26 is preferably spaced apart from plate 52 when position lock 26 is in the "locked" condition as shown in FIG. 5, for reasons discussed further below.

Figure 6:
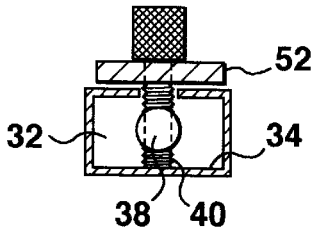
FIG. 6 is an end view, similar to FIG. 5, showing the clamp in an "unlocked" condition

Referring to FIG. 6, when bolt 40 is at least partially threadingly withdrawn from the locked condition, rod 38 is released from firm contact with inner wall 32 adjacent mouth 36 and may thereby slide in channel 20 relative to post 12. This condition is referred to herein as the "unlocked" condition.

Figure 7:
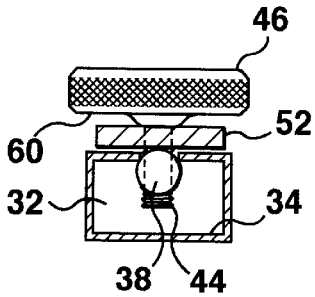
FIG. 7 is an end view along arrow 7 of the display clamp of FIG. 4, shown in a "clamped" condition.

As discussed, bolt 44 of clamp 28 may also be advanced into and withdrawn from rod 38. Referring to FIG. 7, when bolt 44 is advanced into rod 38, by turning knob 46, eventually the undersurface 60 of knob 46 bears against plate 52 and thereby pins it between the opposed surfaces of undersurface 60 and rod 38. Rod 38 protrudes partially out through mouth 36 of channel 20. This condition is referred to herein as the "clamped" condition. Preferably, undersurface 60 is flat and has sufficient area to generate a satisfactory clamping pressure on hook plate 50 when in the clamped condition. Note that in this embodiment, when in the clamped condition, the pinning of hook plate 50 does not exert pressure on post 12 at mouth 36 and, thus, rod 38 is not prevented from sliding relative to post 12 merely because clamp assembly 24 is in the clamped condition.

Figure 8:
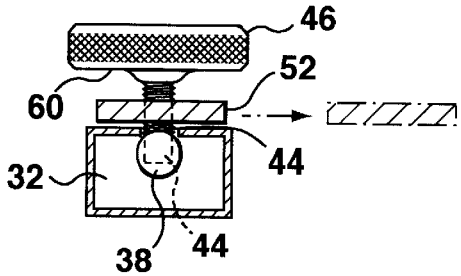
FIG. 8 is an end view similar to FIG. 7, showing the clamp in a "released" condition.

Referring to FIG. 8, when bolt 44 is at least partially threadingly withdrawn from the clamped condition, hook plate 50 is released from between undersurface 60 and rod 38 and is thereby free to be removed from clamp assembly 24. This is the "released" condition.

Figure 9:
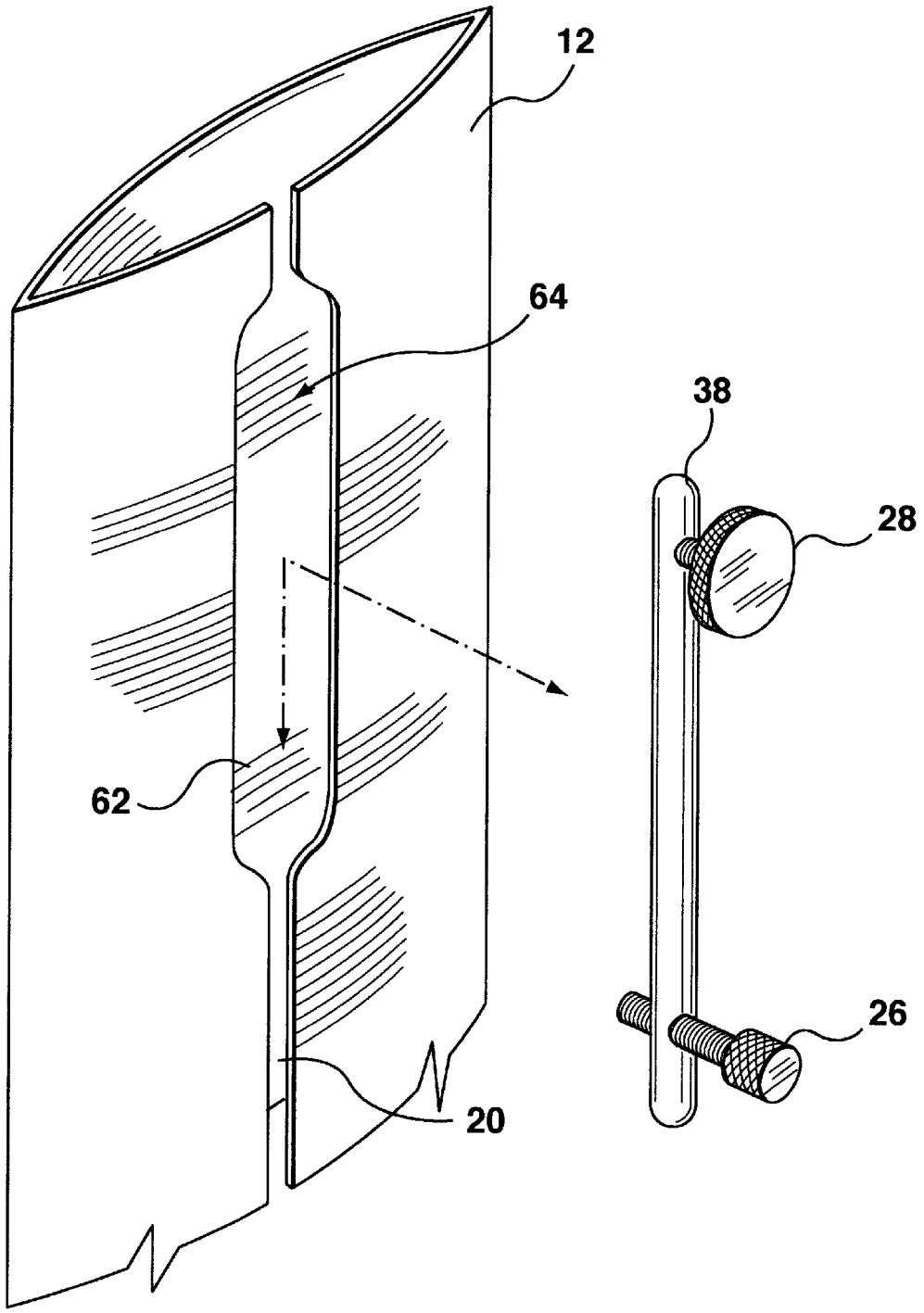
FIG. 9 is an enlarged isometric view of a portion of FIG. 1.

Referring again to FIG. 1, to facilitate the insertion of rod 38 into channel 20 (and its subsequent removal therefrom), channel 20 is provided with an insertion feature 62. As shown also in FIG. 9, in this embodiment insertion feature 62 is a breach 64 in which a portion of mouth 36, preferably near one of the ends of channel 20, has been widened to permit to rod 38 to pass laterally therethrough into channel 20, after which rod 38 can then advance axially along channel 20 to a desired position on post 12.

In use, a rod 38 is inserted into each post 12 through breach 64 and advanced through channel 20 to a desired location. Knob 42 on position lock 26 is then turned to advance bolt 40 into rod 38 to place clamp assembly 24 in a locked condition. Display element 22 is then positioned such that lower slot 54 on hook plate 50 can be mated with bolt 40 of position lock 26 on each post 12 (FIG. 4). Hook plate 50 is then rotated, as shown in FIG. 4, towards bolt 44 of clamp 28, and is fully engaged thereupon, as shown by the phantom lines in FIG. 4. Hook plate is thus supporting display element 22 on bolt 44 by hook 58. Lower slot 54 bears against bolt 42 to align and prevent rotation of display element 22. Hook plate 50 is fixed in place by turning knob 46 to advance bolt 44 into rod 38 until a clamped condition is achieved (FIG. 7).

Once element 22 has been installed and clamped on clamps 24 in this manner, the position of element 22 relative to post 12 may be moved, if desired, without first having to remove element 22. This is accomplished by loosening position lock 26 on each clamp assembly 24, while taking care to manually support element 22 in some manner, and then sliding clamps 24 (and elements 22) up and down along channels 20 to a new position. Position lock 26 is then re-locked, as described above. When desired, element 22 may be removed while position lock 26 remains in the locked condition simply by unclamping clamp 28 as already described above.

One of the advantages of the clamp assembly of present invention is the separation of the position locking and equipment clamping functions of the device. The clamp assembly of the present invention permits display equipment to be mounted thereon, or removed therefrom, while the clamp remains locked in position on the post. Likewise, it permits the clamp assembly to be repositioned in the channel without the need for removing the display equipment therefrom. Advantageously, this allows a person working alone to remove or reposition a display relatively quickly and easily. The risk of dropping the display equipment and/or merchandise is reduced. As well, the simplicity of the present invention makes it both inexpensive to manufacture and easy to use.

It has been found that a rod of 7/16" to 3/8" diameter is suitable for use in the channels provided on retail display systems which are already commercially available. Consequently, the present invention may be quickly and easily retrofitted onto almost any known retail display system having a suitable channel(s).

Figure 10:
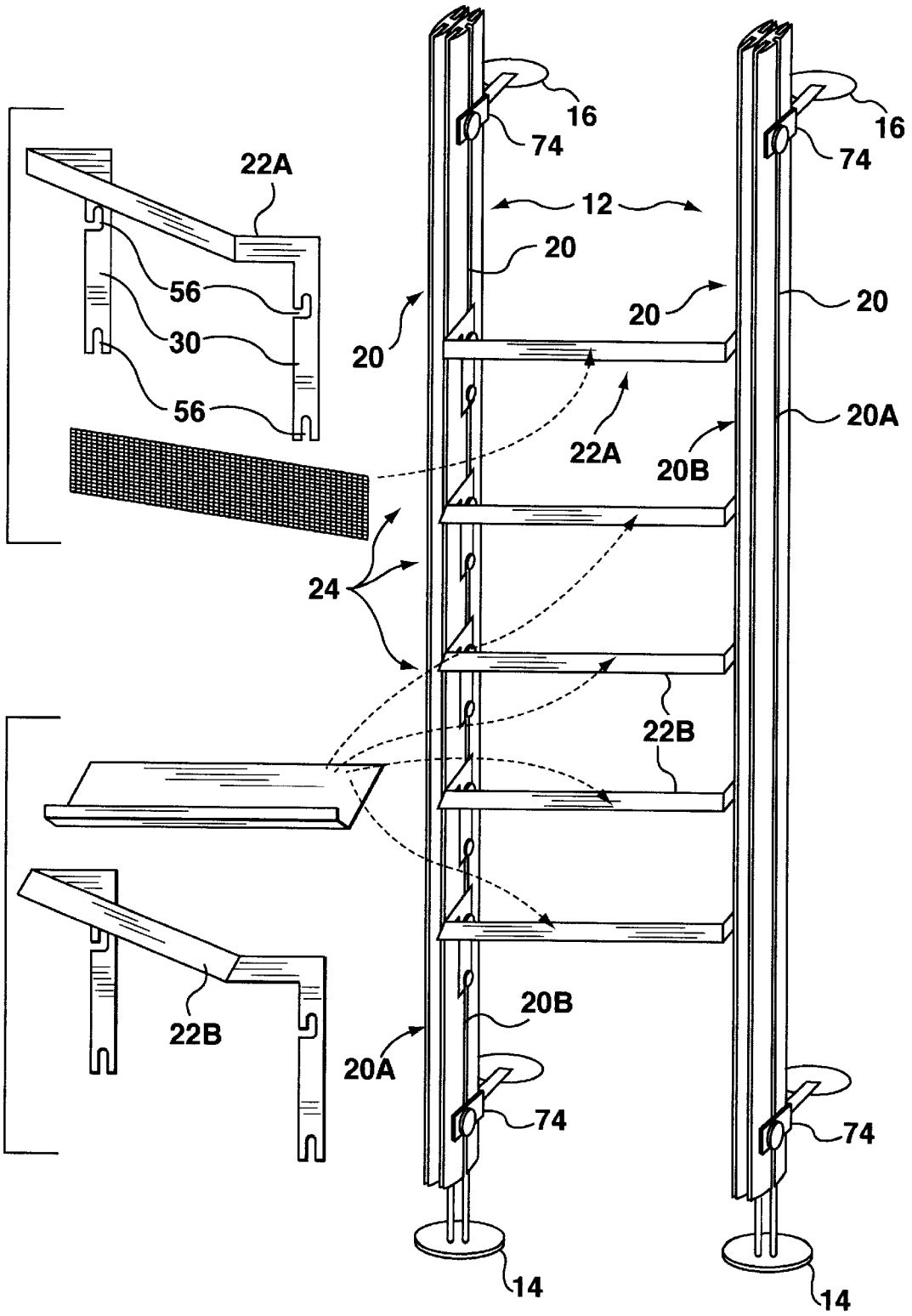
FIGS. 10–12 are isometric views of alternate display rack configurations embodying the present invention.
Figure 11:
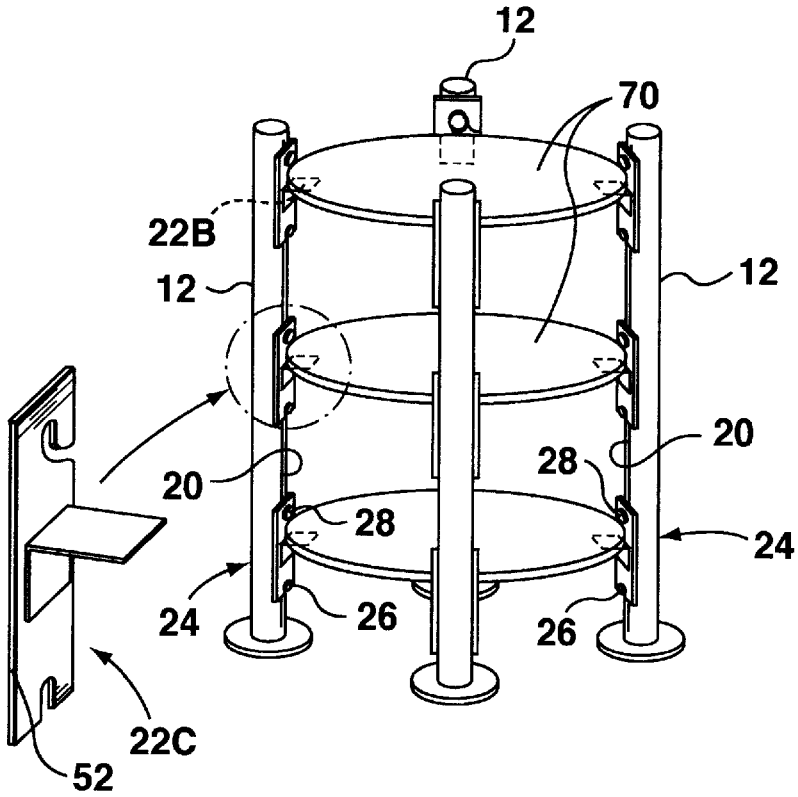
Figure 12:
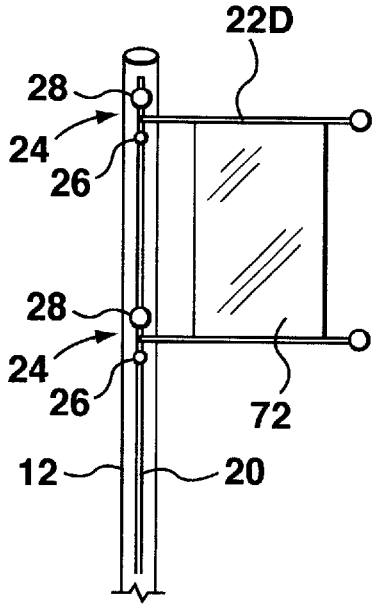

As one skilled in the art will appreciate, the variety of configurations of display apparatus which may incorporate the present invention is limited only by the designer's imagination. Referring to FIG. 10, display element 22 may be configured to provide a shelf support 22A or an angled book support 22B. Referring to FIG. 11, a plurality of posts 12 may be arranged in a circular configuration and a plurality of shelves 70 may rest on a shelf-ledge-like element 22C. Referring to FIG. 12, cantilevered element 22D may be used to support a banner or standard 72. These examples are just a few of the possibilities available.

Figure 13:
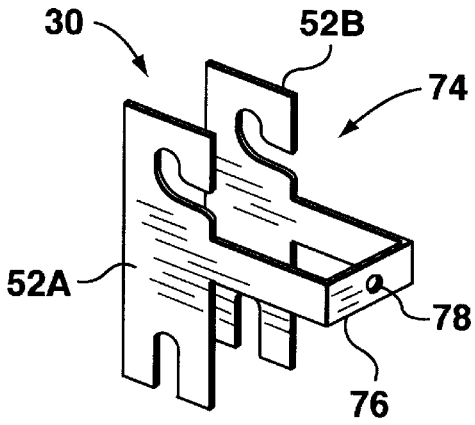
FIG. 13 is an enlarged isometric view of an alternate display equipment according to the present invention.
Figure 14:
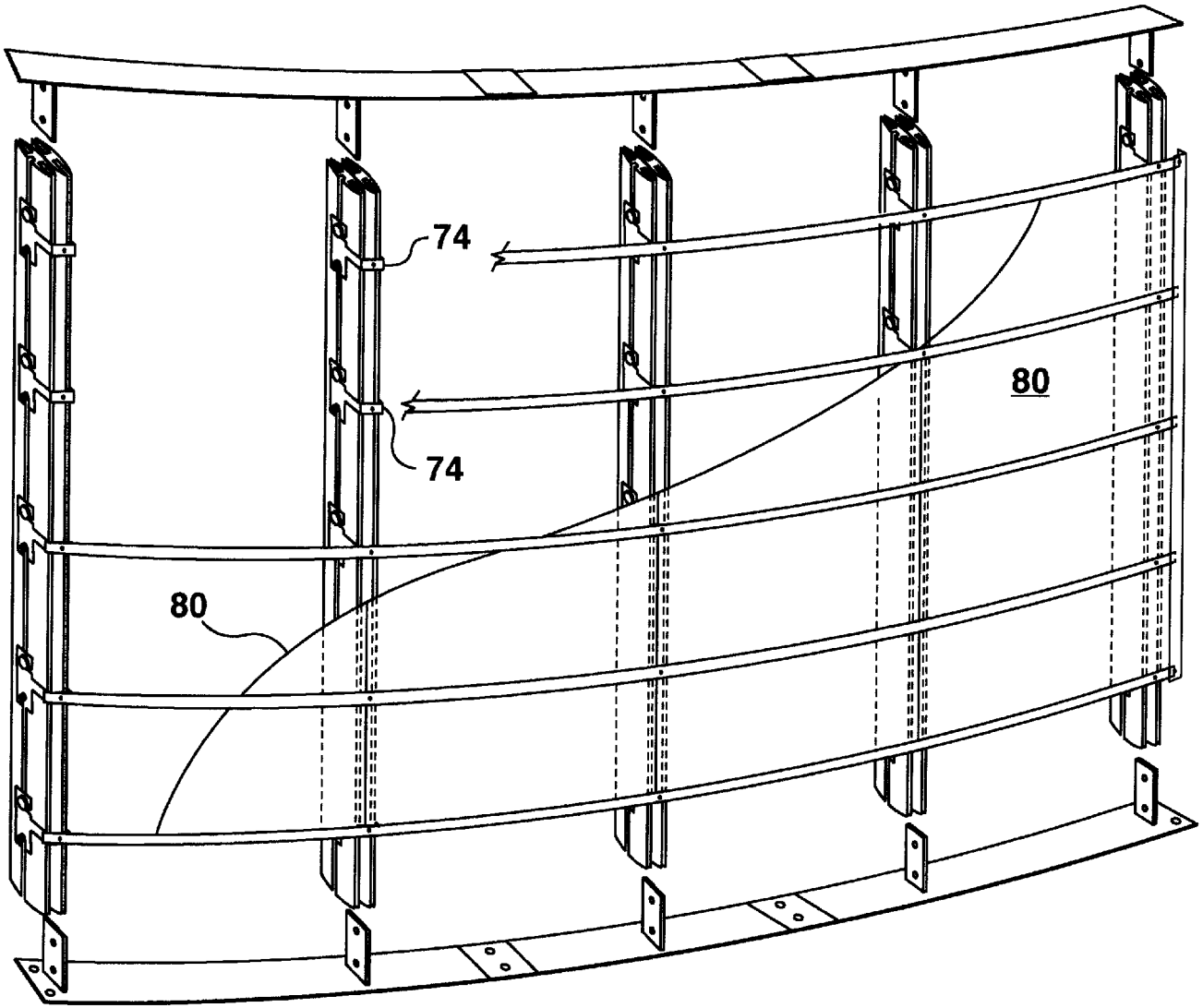
FIG. 14 is an isometric views of a retail display rack incorporating the equipment of FIG. 13.

Referring again to FIG. 10, posts 12 may each have a pair or more of channels 20, in this case a pair of horizontally opposed channels 20*a* and 20*b*. The dual-channel post 12 provides additional locations for mounting element 22 and also permits the use of a dual-armed hook plate 74, as shown in more detail in FIG. 13. Plate 74 includes two hook plates 52A and 52B (each like hook plate 52) spaced apart to permit contact with the outer surfaces of post 12 adjacent the channel mouths, and joined by an arm 76. In use, plates 52A and 52B are engaged by a clamp assembly 24 in each channel 20 in a manner substantially as described above. A mounting hole 78 provided in arm 76 permits further equipment to be mounted thereto, such as the screen panels 80 shown in FIG. 14, or can be used to secure post 12 to a wall mount 16, as shown in FIG. 10.

Figure 15:
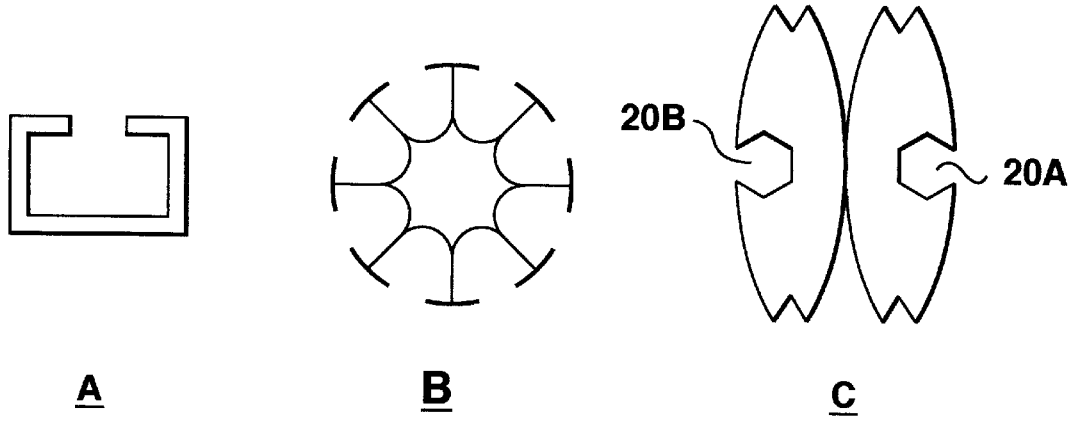
FIG. 15 is a plurality of cross-sectional views of alternate support post profiles for use with the present invention.

Display clamp assembly 24 of the present invention may also be used with a variety of post and channel configurations. Referring to FIG. 15, profile A has a rectangular cross-sectioned recess in a rectangular post. Profile B has recesses which are approximately circular in cross-section and has an overall octagonal profile. Profile C has hexagonal recesses with a curvilinear overall profile. As one skilled in the art will understand, almost any post and recess profile may be used with the present invention as long as a correspondingly-shaped elongate member 38 is chosen to achieve the functionality described above.

While the above description constitutes the preferred embodiment, it will be appreciated that the present invention is susceptible to modification and change without departing from the fair meaning of the accompanying claims.

For example, one skilled in the art will appreciate that position lock 26 and/or clamp 28 need not include threaded bolts, but may comprise any mechanism which may be actuated between a locked condition and a released condition. Likewise, although position lock 26 has been shown and described as appearing below clamp 28 on clamp assembly 24, their respective positions could be reversed. Also, it will be understood that the shape and configuration of the slots on hook plate 50 may be modified without departing from the present invention.

Figure 16:
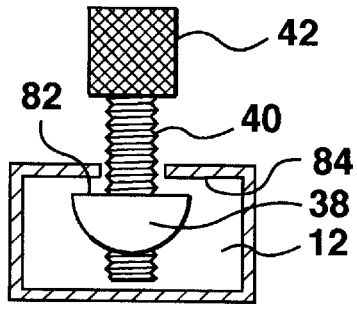
FIG. 16 is an alternate embodiment of the clamp of the present invention.

It will also be understood that when additional clamping force is required on element 22, for example when the merchandise to be displayed on element 22 is quite heavy, providing a rod 38 with a shape complimentary to the shape of inner wall 32 immediately adjacent mouth 36 may be desirable. For example, referring to FIG. 16, rod 38 is provided with a flat surface 82, preferably by milling, to substantially match the flat inner wall 84 adjacent mouth 36. Other shapes may be required for other channel configurations. In embodiments such as this where rod 38 does not partially protrude through the channel mounth, display element 22 is clamped between undersurface 60 of knob 46 and the surface of support post 12.

It will be understood that other clamping mechanisms may be substituted for the threaded clamping mechanism described above. As well, the elongate member and/or support post need not act as a clamping surface, and additional clamping surfaces may be provided. Further, slots need not be provided on the hook plate, nor does the hook plate have to be flat. Alternate position locks may also be used without departing from the essence of the present invention. The shape of the elongate member may be modified, as long as the functionality described above is achieved.

Still further modifications will be apparent to those skilled in the art.

I claim:

1. An apparatus for displaying an article, the apparatus comprising:

a support having an elongate channel defined therein, said channel having an interior, a length and a mouth, said mouth adapted to provide exterior access to said channel interior substantially along said channel length;

a display element for displaying an article, said display element having a plate portion with first and second slots;

an elongate member adapted to be slidingly received and retained in said channel, said elongate member being shorter than said channel length;

a position lock mounted on said elongate member and adapted to extend through said mouth of said channel when said elongate member is disposed in said channel, said position lock being operable to releasably fix said elongate member in a selected position along said length of said channel; and a clamp mounted on said elongate member and adapted to extend through said mouth of said channel when said elongate member is disposed in said channel, said clamp being operable to selective releasably secure said display element plate portion adjacent said support.

2. The apparatus of claim 1 wherein said position lock is capable of fixing said elongate member in said selected position while said clamp is in a released condition.

3. The apparatus of claim 1 wherein said clamp does not prevent said elongate member from sliding in said channel when said plate portion is secured by said clamp.

4. The apparatus of claim 1 wherein said clamp has a portion thereof adapted to be received by said first slot.

5. The apparatus of claim 1 wherein said plate portion has a hook defined by said first slot in said plate portion, said hook adapted to engage a portion of said clamp and thereby permit said display element to hang from said clamp portion.

6. The apparatus of claim 5 wherein said hook permits said display element to hang from said clamp portion while said clamp is in an released condition.

7. The apparatus of claim 6 wherein said second slot is adapted to receive a portion of said position lock, and wherein said second slot is adapted to prevent said plate portion from rotating while said plate portion is hooked on said clamp potion.

8. The apparatus of claim 5 wherein said second slot adapted to receive a portion of said position lock.

9. The apparatus of claim 1 wherein said position lock selectively bears against said interior of said channel to fix said position of said elongate member in said channel.

10. The apparatus of claim 1 wherein said position lock selectively causes said elongate member to bear against said interior of said channel to fix said position of said elongate member in said channel.

11. The apparatus of claim 1 wherein said clamp comprises a pair of opposed surfaces and wherein one of said opposed surfaces is the underside of a knob, said knob being threadingly mounted to said elongate member.

12. An adjustable display apparatus comprising:

a display element for displaying at least one article, said display element having a plate portion with first and second slots;

an elongate member adapted to be slidingly received and retained in a channel defined in a support, said channel being of the kind having an interior and a mouth, said mouth adapted to provide exterior access to the channel interior substantially along the length of the channel;

a position lock mounted on said elongate member and adapted to extend through said mouth of said channel when said elongate member is disposed in said channel, said position lock being operable to releasably fix said elongate member in a selected position along the length of said channel; and a clamp mounted on said elongate member and adapted to extend through said mouth of said channel when said elongate member is disposed in said channel, said clamp being operable to selectively releasably secure said display element plate portion adjacent said support.

13. The apparatus of claim 12 wherein said position lock is capable of fixing said elongate member in said selected position while said clamp is in a released condition.

14. The apparatus of claim 12 wherein said clamp does not prevent said elongate member from sliding in said channel when said plate portion is secured by said clamp.

15. The apparatus of claim 12 wherein said plate portion has a hook defined by said slot in said plate portion, said hook adapted to engage a portion of said clamp and thereby permit said display element to hang from said clamp.

16. The apparatus of claim 15 wherein said hook permits said display element to hang from said clamp while said clamp is in a released condition.

17. The apparatus of claim 16 wherein said second slot is adapted to receive said position lock, and wherein said second slot is adapted to prevent said plate portion from rotating while said plate portion is hooked on said clamp.

18. The apparatus of claim 12 wherein said position lock is adapted to selectively cause said elongate member to bear against said interior of said channel to fix said position of said elongate member in said channel.

19. The apparatus of claim 12 wherein said clamp comprises a pair of opposed surfaces and wherein one of said opposed surfaces is the underside of a knob, said knob being threadingly mounted to said elongate member.

20. An adjustable display apparatus comprising:

a rod adapted to be slidingly received and retained in a channel defined in a support, said channel being of the kind having an interior and a mouth, said mouth adapted to provide exterior access to the channel interior substantially along the length of the channel;

a clamp mounted on said rod, said clamp having a knob adapted to extend beyond said mouth of said channel when said rod is disposed in said channel; said clamp being operable to selectively releasibly secure said display element plate portion;

a position lock mounted on said rod, said position lock having a bolt operable to selectively advance in said channel relative to said rod to releasably fix said rod in a selected position along the length of said channel; and a display element for displaying at least one article, said display element having a plate portion, said plate portion having a hooked slot and an axial slot, said hooked slot adapted to engage said clamp, said axial slot adapted to engage said position lock said knob of said clamp being operable to selectively releasably secure said display element plate portion adjacent said support.

21. The apparatus of claim 20 wherein said rod has a circular cross-section.

22. The apparatus of claim 20 wherein said rod has a flat surface.

23. The apparatus of claim 20 wherein said display element has a second plate portion, said second plate portion being spaced apart from the first plate portion sufficiently to permit said second plate to engage a position lock and clamp on another display apparatus.

* * * * *